United States Patent [19]

Horstketter

[11] Patent Number: 4,706,317

[45] Date of Patent: Nov. 17, 1987

[54] CONCRETE TRAIN PAVING APPARATUS AND METHOD

[76] Inventor: Eugene A. Horstketter, 400 Regentview Dr., Houston, Tex. 77079

[21] Appl. No.: 917,784

[22] Filed: Oct. 10, 1986

[51] Int. Cl.[4] ..... E01D 21/04

[52] U.S. Cl. ..... 14/1; 404/106; 404/108; 404/72; 425/64; 264/34

[58] Field of Search ..... 404/101, 83, 106, 108, 404/72, 119; 14/1; 425/64; 264/31, 34; 104/247; 52/741

[56] References Cited

U.S. PATENT DOCUMENTS

| | | | |
|---|---|---|---|
| 122,498 | 1/1872 | Smith | 404/83 |
| 406,302 | 7/1889 | Pendleton et al. | 104/247 X |
| 1,004,410 | 9/1911 | Gibb et al. | 404/108 X |
| 1,751,147 | 3/1930 | Hackley | 425/64 X |
| 2,969,720 | 1/1961 | Burnham | 404/106 |

FOREIGN PATENT DOCUMENTS

| | | | |
|---|---|---|---|
| 502076 | 4/1976 | U.S.S.R. | 404/106 |

*Primary Examiner*—James A. Leppink
*Assistant Examiner*—Matthew Smith
*Attorney, Agent, or Firm*—Vaden, Eickenroht, Thompson & Boulware

[57] ABSTRACT

Apparatus and method for pouring concrete on a bridge is disclosed employing rail-mounted pouring and related equipment and separate rail-mounted rolling pipe for attachment to a concrete source system located on an approach to the area to be poured. The equipment rail and rolling pipe rail are both mounted on stable overhang brackets located outboard of the area to be poured. A power tractor is also mounted in the approach area on the rolling pipe rail and straddles the vertical reinforcing members located on the outside edges of the bridge deck. The tractor pushes the rolling pipe and permits a flexible hose connection to a stationary concrete pump located on the approach. A spring-loaded telescoping channel connection allows the trolleys on the tractor and the idler trolleys supporting the rolling pipe to be clamped securely to the rail.

6 Claims, 16 Drawing Figures

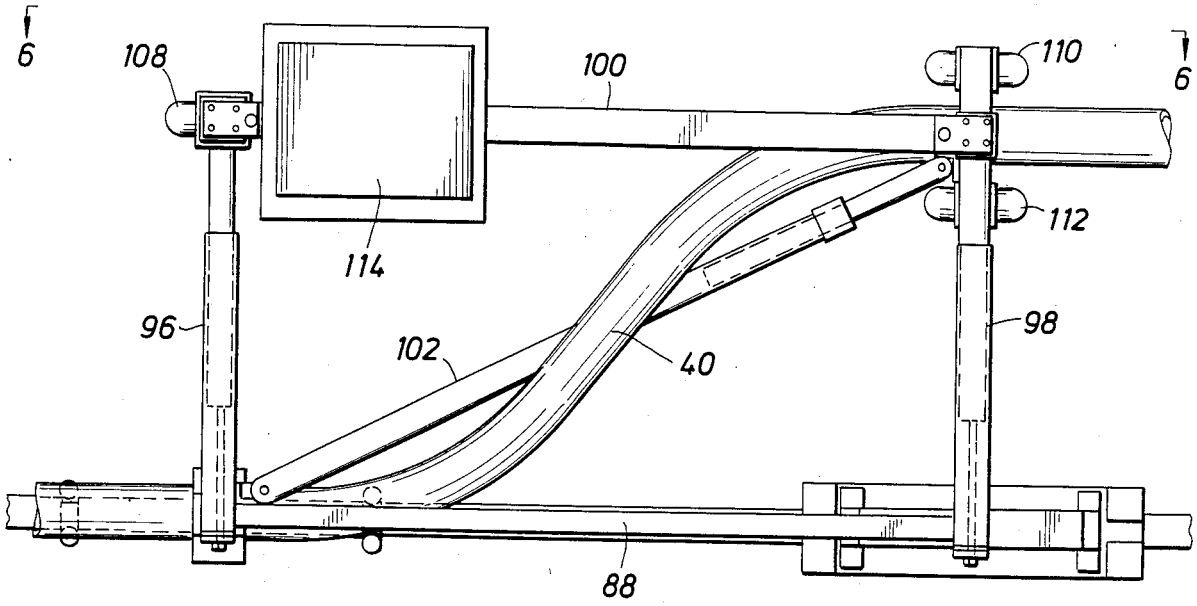
FIG. 5
FIG. 4
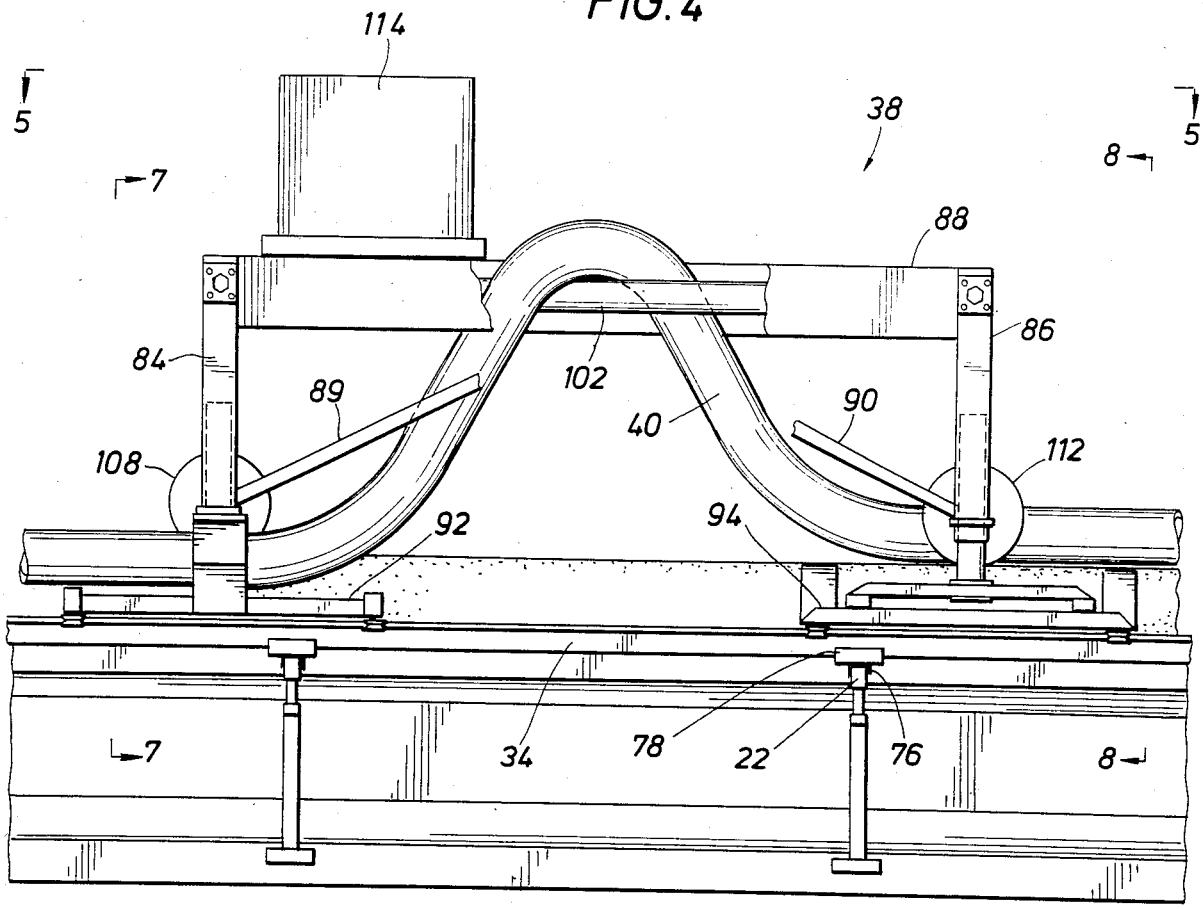

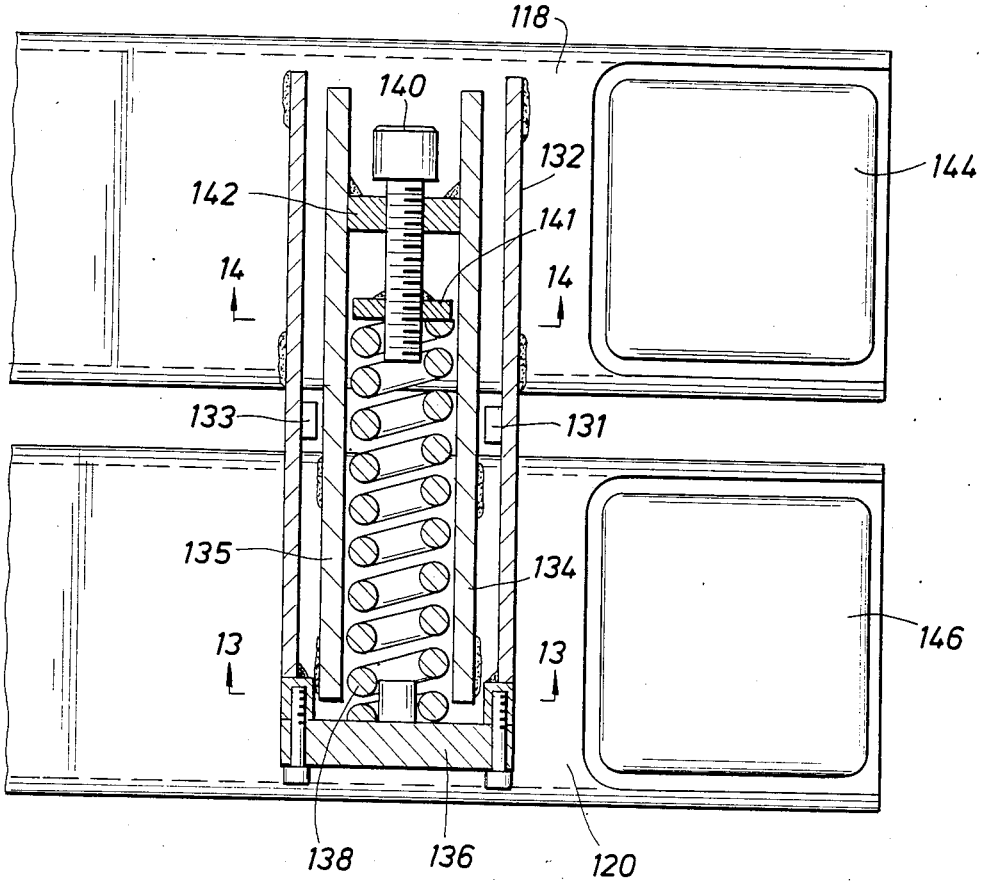
FIG. 12
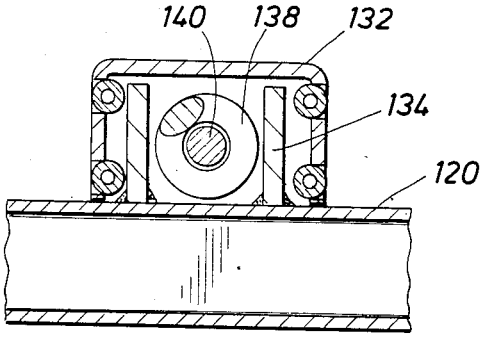
FIG. 13
FIG. 14
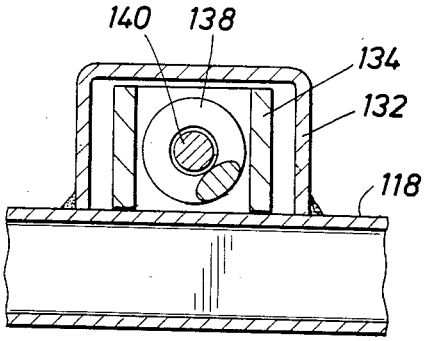

CONCRETE TRAIN PAVING APPARATUS AND METHOD

BACKGROUND OF THE INVENTION

1. Field of the Invention

This invention pertains to apparatus suitable for paving large slab areas, particularly on bridge spans, and a method of paving such areas.

2. Description of the Prior Art

Equipment employed for constructing concrete roads have become increasingly more automated so as to minimize the need for making such construction efforts heavily labor-intensive. As a result, dirt excavation, hauling and placement equipment has been developed for road construction purposes which is highly automatic. With respect to concrete paving equipment used on roads, where once the tasks were almost exclusively done by hand, such equipment is now available to uniformly distribute the poured concrete, grade the pavement to close tolerances and to finish or surface large areas in accordance with rigid design specifications.

Even much of bridge construction is automated or at least prefabricated with the wide-spread use of concrete forms developed to the point where complete bridge bents or span segments are put into place and then set and adjusted with a few bolts and jacks. However, although roadway pavement on the ground has been successfully converted to the use of automated or semi-automated equipment, when the same tasks are performed on a bridge, after the forms and reinforcing steel are in place, the work is still highly labor intensive.

The construction equipment industry has developed and has for many years marketed equipment to perform uniform distribution, achieve close tolerance grading and effect suitable surface finishing of roadway pavement on bridges; however, its use has been limited for lack of a practical and stable means of supporting such equipment where it can be used over the full area where slabs are to be poured. In addition, there has been no practical and economical means of support and supplying or transporting the concrete slurry from a source located in proximity to the other equipment.

There have been two general approaches used in the prior art with limited success for pouring concrete in position on a bridge. In the first approach, the rails on which the equipment are to run are set on the outside edge forms of the deck slab, which is, in turn, are supported on overhand brackets hung from the outside of the bridge beam. This procedure allows the equipment to reach most of the surface area, but because the geometry of the brackets is unstable, especially under the heavy loads imposed by concrete distribution equipment, only light finishing equipment can be used in this approach. The heavy work of uniform distribution of the concrete must be left to be done manually.

The key to why the brackets are unstable can be better understood by a more detailed understanding of their construction. The brackets are attached by a single bolt to an internal hanger that is anchored to the bridge beam, in a manner that provides easy erection and permits the easy removal of the bracket after the concrete has been placed and cured. The internal hanger remains imbedded in the concrete. This construction allows the hanging of the bracket manually from the top of the beam without the use of scaffolding. All the currently popular brackets employ this construction.

Because the overhang bracket is by its nature a cantilever, a combination of imposed vertical loads and reaction horizontal loads must be provided for. The currently popular brackets provide for this combination of vertical and horizontal loads by hanging the bracket from the "hanger" with the single bolt placed at a 45 degree angle between the vertical and horizontal, in anticipation that the two loads will balance each other. In normal usage where the brackets carry only the concrete deck, the two loads do balance close enough to provide satisfactory results. However, when loading varies from equipment wheel loads well out on the brackets to concrete loads nearer the supporting beam the two loads do not balance and the bolt must swing from its 45 degree angle to an angle that will coincide with the imbalance of the loads. This swinging of the hanger bolt obviously causes the bracket, forms and equipment rail to move from their set positions in a rocking motion under loads alternating between moving equipment loads and concrete loads. Some contracting agencies will not permit even the use of light finishing equipment carried on the currently popular overhang brackets because their unstable geometry gives mixed results, as to uniformity and consistency of the grade.

In the second approach, the concrete and forms are carried on overhang brackets, but rails on which the equipment spread is to run is supported on "chairs" above the finished grade over two outside bridge beams. This technique provides for efficient use of the paving equipment spread, including uniform distribution, close tolerance grading, and finishing of most of the area between the two outside bridge beams, but leaves the area within a couple of feet and to the outside of the beams to be worked by hand. Moreover, the rails and their supporting "chairs" must be immediately removed and the "chair holes" patched and refinished. Tine texturing must be done by hand.

The method disclosed and claimed herein is specifically designed to support both concrete distribution and finishing equipment on rails mounted outside of the paved area so the entire area can be worked, and to do so with stability so that the grades established before concrete placement starts will be there after placement is finished.

To overcome the problem of instability under moving loads while maintaining all the convenience of a single bolt attachment to an internal hanger, the beam member of a preferred bracket used in the procedure to be described is designed with a rigid vertical beam extension on the attachment end of the beam. This bracket construction is more completely described and shown in detail in U.S. Pat. No. 4,660,800 entitled "Bridge Overhang Bracket and Hanger", issued Apr. 28, 1987, Eugene A. Horstketter, which application is incorporated herein for all purposes. Since the top of this vertical extension will be encased in the concrete along with the hanger, but will be withdrawn as the bracket is removed, it is preferably made conical to assure ease of removal. The hanger bolt extends through the top of the cone and attaches to the hanger. As the nut on the bolt is tightened, it draws the top of the cone up into a recess in the hanger, resulting in an attachment that permits limited swival action, but which will not permit either vertical or horizontal movement of the beam end regardless of the balance between imposed vertical loads and reaction horizontal loads due to concrete placement or moving equipment.

SUMMARY OF THE INVENTION

The apparatus described and illustrated herein, preferably in conjunction with the bracket disclosed in U.S. Pat. No. 4,660,800, provides the means to receive delivery of all the concrete for a pour at one point on one side of a bridge, or on long bridges on the last fully cured slab in place, and to deliver it directly to a distributor working the pour, with no obstruction to the paving equipment or the work in progress, and with coordination required only directly between the concrete delivery and the distributor.

The modern method of handling the concrete on a deck slab pour that places the concrete most directly in its final position, and therefore requires the least amount of hand labor and provides for the highest productivity, is the side discharge belt conveyor distributor. The most effective use of the distributor is achieved when the rail upon which it travels is located and supported on overhang brackets outside of and clear of the slab being poured, so no interference with productivity or finishing is encountered. In order to keep up the productivity so achieved, a bridge deck concrete shaping and finishing machine that travels on the same rail is normally employed. The apparatus employed in the preferred embodiment contemplates this arrangement and, in addition, is intended to work with such a paving spreader to further increase productivity by providing a continuous uniform flow of concrete to the distributor, as well as to eliminate the need for access from below, and the heavy equipment required to work from there.

In using the procedure more completely described below, a stationary concrete pump, with capacity to produce the desired progress, is set up at a point on the bridge approach roadway pavement or subgrade conveniently accessible to concrete delivery trucks. The concrete train rail, preferably a mono "T" rail, is erected on the overhang brackets and on the bridge approach roadway, outboard of the paving spread or equipment support rail, and extending from the forward end of the pour to a point that is back from the starting end of the pour a distance equal to the length of the pour, with a little extra on each end. Then, with the paving spread in place at the starting end of the pour, rolling concrete pipe is installed on the rail, to clear outside of and under the paving equipment, to a length a little longer than the pour. The downstream end fixture of the rolling pipe is installed and attached to the hopper of the distributor. A tractor tag-along control lever is attached to the distributor and adjusted to keep the end fixture connection to the hopper within the limits of its flexibility. The concrete pipe tractor is then connected to the downstream end of the pipe and clamped onto the rail. A length of concrete hose approximately 1½ times the length of the pour is connected to the downstream end of the tractor and laid out on the ground in a serpentine configuration so that the opposite end is approximately across the roadway from the connected end. That end of the hose is then connected to the concrete pump using stationary pipe, if and as necessary, to reach the pump.

The pour is started by pumping concrete to the distributor. The distributor spreads the concrete and the finisher starts to shape and finish it. As the pour progresses, the tractor, responding to signals from the tag-along controller, pushes the pipe forward on the rail to maintain contact with the distributor. As it does so, it pulls the serpentine out of the hose so that, upon completion of the pour, the hose is in a slack but more nearly straight line between its downstream connection to the pump, or stationary pipe, and the tractor.

The procedure is repeated with subsequent pours by the addition of stationary pipe or rolling pipe as convenience dictates. If the bridge is of a length that slabs cure sufficiently to carry the concrete delivery trucks, the stationary concrete pump is moved out onto the bridge and concrete delivery is received there. The pump is moved ahead for each pour to keep the pump line from getting too long. The length of the pump line on long bridges will be determined by the rate of progress of the bridge and the required curing period. For example, at a rate of one span per week and a 28-day curing period, the pump will be preferably four spans back, and at a rate of two spans per week and a 21-day curing period, the pump will preferably be six spans back. On continuous span checkerboard layouts, the pump will preferably be set up on the previously completed and cured unit and provision for each pour will be made by varying the length of the rolling pipe used.

The equipment and material that make up the apparatus utilized in the procedure just described preferably comprises a "T" rail which is mounted on the overhang brackets, and the bridge approach, outboard of the paving equipment rail, a concrete pipe with downstream end fixture to discharge into the distributor hopper, both of which are mounted on the "T" rail by the use of rolling pipe trolleys, and a hydraulic motor powered concrete pipe tractor also mounted on the "T" rail but with additional wheels that run on the deck. The tractor is attached to the concrete pipe so that it can push the pipe along the rail to maintain the end fixture in position to discharge into the distributor hopper continuously as the distributor moves across the pour, while also maintaining its attachment to the concrete supply hose.

The "T" rail is preferably made from a standard rolled structural tee cut from an "S" shaped beam that has the tee head milled to provide a uniform width with 60 degree Vee edges. At the support points, nominally at eight feet center to center, a pair of relatively short angles are welded to either side of the leg of the tee to form an "H" shape. A steel plate saddle made to fit over, and pin to, the supporting overhang bracket, and with a slot guide arrangement made to fit the bottom horizontal legs of the angles that are welded to the tee leg, provides an attachment to the overhang bracket that supports the rail. Such a structure also resists transverse horizontal and rotational loads as well, while allowing appreciable tolerance for longitudinal placement of the rail and/or the bracket. The ends of "T" rail segments are reinforced and fitted with pin and socket connectors to transmit vertical, horizontal, and rotational loads. The socket end is a short length of steel tubing welded in the vertical position to the lower part of the reinforced tee leg. The pin end is a vertical pin, of a size to fit into the socket, welded to the head of the tee and to the adjacent reinforced leg. To erect the rail, a segment of rail ten feet in length with the socket half of the connector on both ends, is installed across two adjacent brackets. Another like segment is installed on the next pair of brackets, and a six foot segment with the pin half of the connector on both ends is dropped in to connect the two ten foot segments to thereby form a continuous rail.

Typically the concrete pipe is a six-inch steel pipe with couplings on approximately ten foot centers and the end fixture is a long radius pipe elbow turned up with a hose extension to provide flexibility. However, the concrete pipe can be any pipe through which concrete can be pumped, and the downstream end fixture can be any means to direct the flow of concrete in the pipe into the hopper of the distributor. The rolling pipe trolleys are made up of a pipe saddle of structural steel channel which is tightly strapped to the bottom of the pipe, and to which a pair of vertical shaft Vee grooved wheels are attached. The wheels are on a spacing that makes the Vee grooves in the wheels engage the Vee edges of the head of the "T" rail. In this way, the pipe is supported and held in alignment over the rail and can be rolled along the rail with minimal resistance. Trolleys are preferably strapped to the pipe on approximately ten-foot centers or one per pipe joint.

The tractor comprises a four "wheel" rigid frame made to straddle from the "T" rail out on the overhang brackets, over the bridge railing reinforcing steel that normally sticks out of the slab near its edge, and to the surface of the previously poured slab on the inside of the protruding reinforcing steel. The two "wheels" on the outside consists of one power trolley and one idler trolley, both mounted on the "T" rail, and the two wheels on the inside, both idlers, comprise one single pneumatic tire wheel and one dual set of pneumatic tire wheels to ride on the previously poured slab or, in the case of the first slab, at the end of the bridge on the approach slab or subgrade.

On the outside, the idler trolley is under the upstream leg and is made up of two pairs of the same vertical shafted Vee grooved wheels that are used on the rolling pipe trolleys. The pairs are spaced apart on a spacing beam to distribute loading on the "T" rail and are mounted to the spacing beam on small transverse telescoping beams so they can be spaced to engage the head of the "T" rail in use, or be spread apart for removal of the tractor from the rail. The leg of the tractor at this point is a structural ring to allow the concrete pipe, which is on the same alignment over the rail as the leg, to pass through the leg. The concrete pipe is attached to the leg at this point for support and to apply the push or pull necessary to move the concrete pipe along the rail. The means of attachment depends on the type of concrete pipe used.

The power trolley is made up of two pairs of vertical shafted hydraulic motors, fitted with Vee grooved wheels similar to those on the rolling pipe trolleys, again mounted on a spacer beam to spread them apart to distribute the loads on the rail. A powerful spring is mounted between each pair of hydraulic motors to pull them together so their Vee grooved wheels clamp tightly onto the "T" rail head to provide the friction necessary for traction. Provision is made to release the spring load and to move the motors apart for removal of the tractor from the rail.

On the inside, the dual set of pneumatic tired wheels is under the downstream leg. A dual wheel arrangement is used to allow the attachment of the concrete supply hose to be concentric with the leg. Again the means of attachment depends on the type of concrete hose used, but attachment must be capable of substantial horizontal pull necessary to drag the hose across concrete slab or subgrade. The single pneumatic tire wheel on the upstream leg carries most of the weight of the hydraulic pump and control unit and balances the varying combinations of loads on the other three "wheels".

Between the outside upstream attachment of the concrete pipe and the inside downstream attachment of the concrete hose, a concrete flow line is installed over and above the protruding reinforcing steel. This flow line can be either a length of hose or a specially fabricated piece of pipe.

The rigid frame is of sufficient strength to carry the load of the concrete cross-over flow line and the hydraulic pump and control unit, and to transmit the tractor effort of the power trolley to the concrete pipe upstream and to the concrete hose downstream. To provide for varying site conditions, the vertical legs on the inside and the horizontal cross-over beams are made screw jack adjustable, and the top horizontal diagonal member is made slide adjustable to accommodate any adjustment of the horizontal cross-over beams, but friction clampable to act as a diagonal brace, after the adjustment is made. The diagonal brace member also acts as a beam to carry the cross-over concrete flow line. To allow for use of this equipment on either side of the bridge, the idler trolley and the power trolley are made interchangeable, and the frame member on which the pneumatic tired wheels are mounted, the diagonal brace member, and the hydraulic pump and control unit support platform are all reversible.

A hydraulic pump unit of approximately ten horsepower that will delivery approximately 8 gpm at approximately 15 psi will be sufficient to power the tractor. The hydraulic circuit is parallel with a single 4-way, closed center, three position, control valve. It is closed center to prevent free wheeling on vertical grades. The tag-along controller with a slack line tie to the distributor signals the controller valve via a control wire attached to and along side the rolling pipe between the controller and the tractor so that no operator is required for the tractor.

From the above, it will be seen that it is a feature of the present invention to provide an improved method of automatically pouring concrete in place for making bridge slabs and the like by stabilizing a support area outside of the area to be poured so that it can suitably support the heavy equipment required in an automatic pour and treatment procedure.

It is another feature of the present invention to provide an improved method of automatically pouring concrete in place for making bridge slabs and the like utilizing concrete slurry source and the feed apparatus in situ at bridge level for operating in conjunction with one or more of distribution, finishing and texturing apparatus.

It is still another feature of the present invention to provide an improved method and apparatus for sourcing concrete slurry to a movable distributor of the concrete used in conjunction with subsequent equipment working the newly poured concrete, as they are employed in pouring a concrete slab in bridge construction or the like.

BRIEF DESCRIPTION OF THE DRAWINGS

So that the manner in which the above-recited features, advantages and objects of the invention, as well as others which will become apparent, are attained and can be understood in detail, more particular description of the invention summarized above may be had by reference to the embodiments thereof that are illustrated in the appended drawings, which drawings form a part of the specification. It is to be noted, however, that the appended drawings illustrate only preferred embodiments of the invention and are therefore not to be considered limiting of its scope as the invention may admit to other equally effective embodiments.

In the Drawings:

FIG. 4 is a side view of a preferred embodiment of the tractor portion of the present invention.

FIG. 5 is a top view of the tractor shown in FIG. 4 taken at line 5—5 therein.

FIG. 12 is a top cross-sectional view of the rail clamping mechanism shown in FIG. 11 taken at line 12—12 of FIG. 10.

FIG. 13 is a cross-sectional view taken at line 13—13 of FIG. 12.

FIG. 14 is a cross-sectional view taken at line 14—14 of FIG. 12.

DESCRIPTION OF THE PREFERRED EMBODIMENTS

Figure 1:
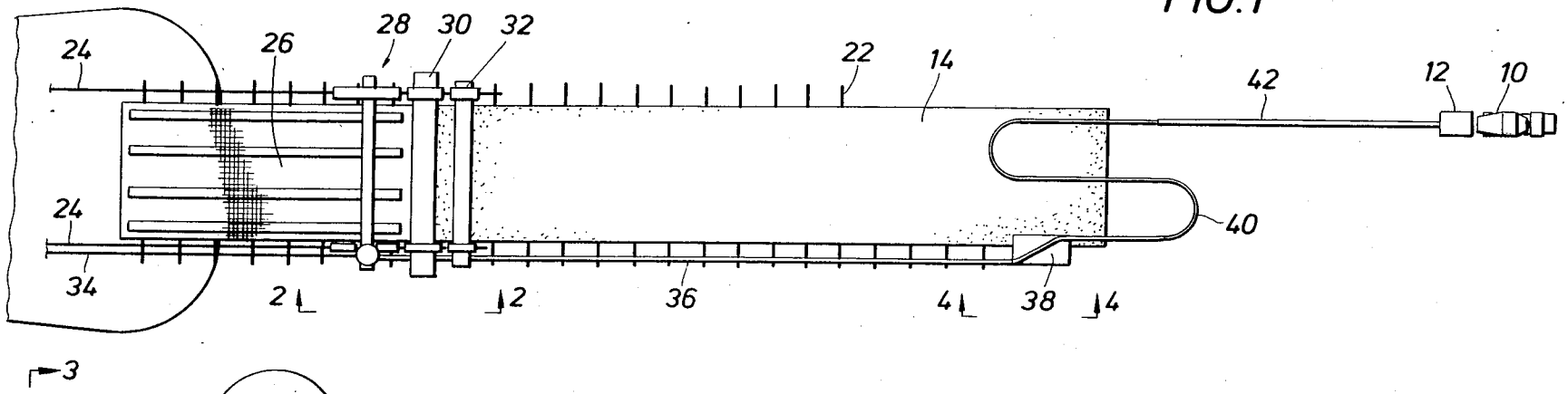
FIG. 1 is a plan view of a typical bridge installation in accordance with a preferred embodiment of the present invention.

Now referring to the drawings and first to FIG. 1, a plan view of a typical bridge installation is illustrated in accordance with the present invention. The illustration is representative of the use of the invention on a short bridge, the start of a long bridge, the use on subsequent spans of a typical long bridge and even the use of pouring concrete in sections on an extremely long bridge, which pouring is quickly done in a multi-span, checkerboard configuration.

Concrete truck 10 and stationary concrete pump 12 are located on an approach to the area to be poured, which approach can be a roadway pavement or subgrade or a cured section of the bridge which has already been poured and that is strong enough to support the concrete truck and the stationary concrete pump just described. The approach is accessible so that other trucks can replace the truck that is in service, as the need arises and the pouring of concrete progresses. Adjacent to the approach is a poured concrete slab 14, which has been poured in accordance with the invention as hereinafter described. Concrete slab 14 has been poured on a deck support 16, which is better illustrated in FIG. 3, which, in turn, is supported in its main section by appropriate I beams 18. It should be further noted from FIG. 3 that deck support 16 extends outside of the two outside I beams. Very stable overhang brackets 22 of the type preferably described in Ser. No. 793,175 are included in the structure shown in FIG. 3 and illustrated in schematic form in FIG. 1. However, the overhang brackets can be of any suitable rigid structure capable of supporting the railing and the equipment carried by the railings in a manner hereafter described.

Overhang brackets 22 are spaced along the bridge on either side at 8-foot intervals and are capable of supporting the paving spread and equipment support rails 24 outboard or alongside of poured slab 14 and the area to be poured 26. The equipment support rails support distributor 28, concrete finisher 30 and texturing machine 32, functionally described in a bit more detail below. Although rails 24 are shown only opposite the area 26 to be poured where they are essential to pour area 26, it is to be understood that they can be installed opposite the poured area 14 and any other area which has been poured and all areas to be poured in addition to area 26. Therefore, rails 24 can be provided along the entire distance for supporting and carrying the equipment just identified to the desired site.

Figure 2:
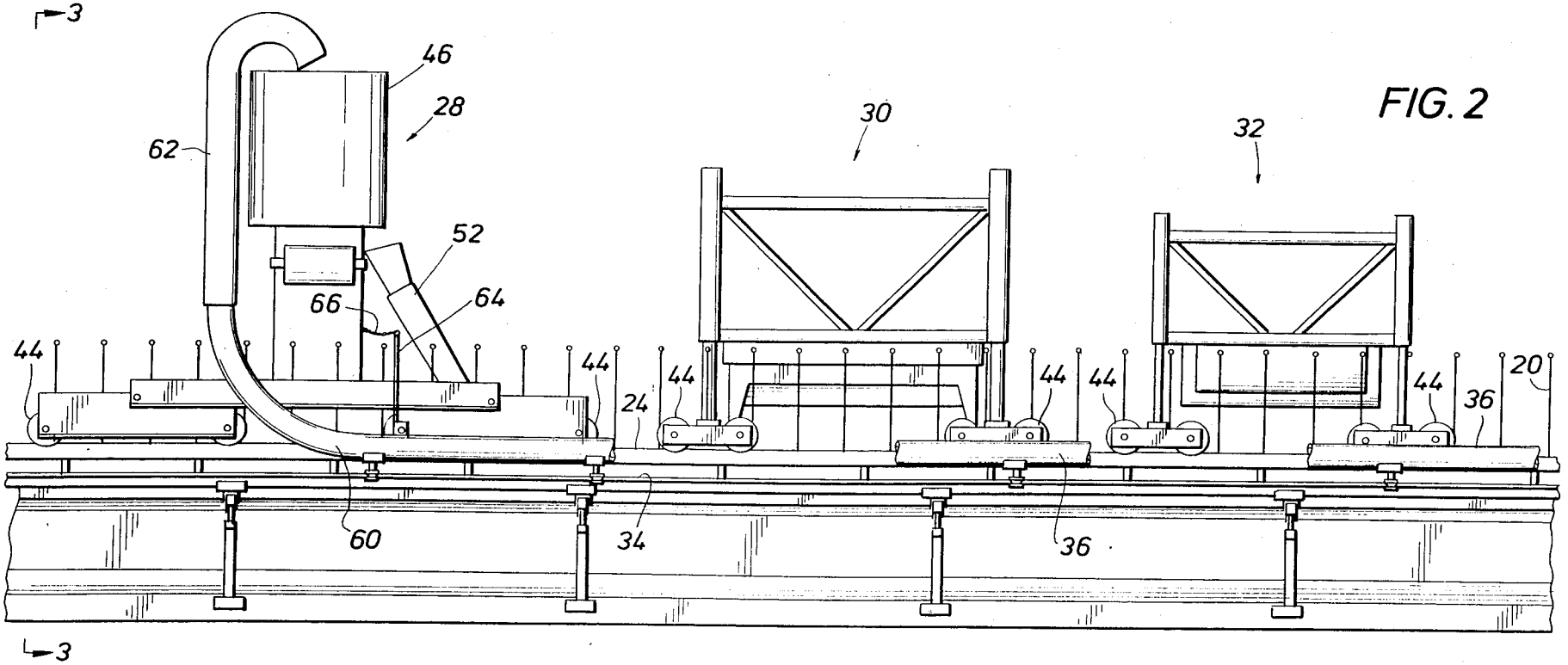
FIG. 2 is a side view of part of the equipment utilized in pouring concrete in accordance with a preferred embodiment of the present invention.
Figure 3:
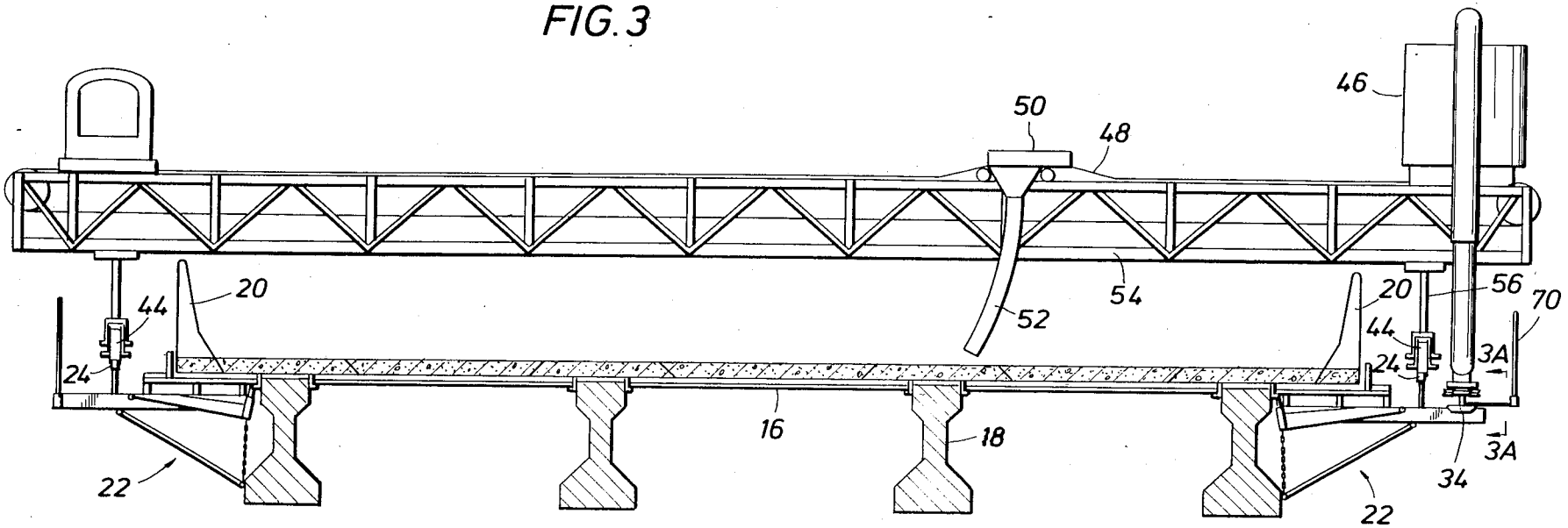
FIG. 3 is a cross-sectional view taken at line 3—3 shown in FIG. 2.

Alongside rail 24 on one side of the area to be poured is another rail 34, which can be characterized as concrete train rail or rolling pipe rail. As is best seen in FIG. 2, rail 34 is lower than rail 24 and as shown in FIG. 3, rail 34 is outboard of rail 24. It is apparent that rail 34, like rail 24, is supported by overhang brackets 22. Finally, a safety hand rail 70 is provided outboard of rail 34, which hand rail is also supported by overhang brackets 22.

Now referring to FIG. 2, the respective rail structures along with the equipment carried by such rails that have been described are shown in composite as they appear in the vicinity of the pouring activity. Distributor 28 and finisher 30 together form a unit which move in train-like coordination with respect to the area to be poured during the pouring operation. Texturing machine 32 follows as ideal concrete hardening dictates. All of this equipment is supported by appropriate rollers 44 compatible with riding along rail 24. Each piece of the equipment is respectively powered by a motor attached to at least one side of such equipment. Such rails and their rollers have been employed in the art in stable roadbed construction. In addition, distributors, finishers and texturing machines are well known in the art and have previously been rail-mounted in a manner similar to that which is illustrated in the drawings in ground-level construction and in less efficient ways as previously described, on bridges.

Rail 34 supports rolling pipe 36 in a manner to be described more fully hereinafter. The rolling pipe is moved during the pouring operation by an appropriate tractor 38, which is partly mounted on rail 34 and partly on pneumatic tires, again as more fully described below. Tractor 38 carries the rear end of the rolling pipe and, in the illustration, pushes it from right to left during the pouring sequence. Beginning with the attachment to a rigid section of pipe 36, which occurs at the front of tractor 38, and upstream from tractor 38, is an appropriate flexible hose 40 which is laid on the ground in a serpentine arrangement to be secured to a stationary pipe 42, which, in turn, is connected to stationary concrete pump 12. The hose is sufficiently long to permit the rolling pipe to move forward to allow an entire span area 26 to be poured and processed by the forward train of equipment previously described. Pump 12 and truck 10 are conveniently located across the roadway from tractor 38. It should be noted that stationary pipe 42 is optional since the hose length may be sufficient to connect directly to pump 12. Furthermore, the stationary pipe may be located elsewhere than in the arrangement from that which is shown, if desired.

Since the first slab to be poured is located subsequent to the approach, rail 34 extends alongside such approach to permit the pouring of this first area in the same manner as subsequent areas. Rails 24, on the otherhand, need not extend appreciably past the first area to be poured.

Returning to the sequence of operation during a pour with respect to FIGS. 1 and 2, a concrete slurry is pumped from pump 12 through pipe 42, hose 40 and rolling pipe 36 to be discharged from the downstream end fixture attached to the end of the rolling pipe into input hopper 46 of distributor 28. The end fixture of rolling pipe 36 includes an elbow 60 in the vicinity of hopper 46 and a discharge hose connection 62 which has a bend at the top for discharge delivery directly into the hopper. The distributor partly smooths the concrete in area 26 as it is poured. Finishing apparatus 30 is preferably a paving machine comprising such items as a vibrating screed, bridge deck concrete shaping and finishing spreaders, and appropriate rollers for further smoothing the plastic concrete and removing voids or air pockets and to level the concrete at the appropriate height. Finally, a texturing machine 32 including appropriate transverse or longitudinally grooving rakes make appropriate marks in the concrete as it is still in the plastic form so as to provide a surface which is resistant to skidding during rainy weather. Again, each of these items of equipment is appropriately mounted to rails 24 on either side and outboard of the area to be poured by appropriate rollers attached to trolleys in a fashion well known in the art.

Distributor 28 is preferably a side discharge belt conveyor and is more fully illustrated in FIG. 3. Side discharge conveyor belt 48 of the distributor moves the freshly received concrete from the hopper in a direction away from hopper 46. The concrete is appropriately diverted by diverter 50 mounted with respect to conveyor belt 48 so as to deflect the slurry through chute 52 to the area 26 to be poured. The chute and the conveyor move in a coordinated fashion by an operator from right to left and then from left to right so as to pour the concrete slurry during its movement in a continuous and even manner. The concrete conveyor belt is supported by a bridge 54 that is mounted sufficiently high so as to clear the vertical railing reinforcement members 20. Legs 56 attaching bridge 54 to rollers 44 provide this distance.

Referring again to FIG. 2, rolling pipe 36 is appropriately secured with respect to trolleys 58, which are, in turn mounted to rail 34. Pipe 36 is pushed forward, that is, from right to left, as the pour progresses.

A tag-along controller 64 is attached to distributor 28 via a chain 66 that activates a switch when it becomes taunt. A signal wire connection is made from the switch to tractor 38. The switch activation causes the tractor to move forward with the rolling pipe an incremental distance, such forward movement causing the chain to become slack, until the distributor has moved away from it again. The tag-along controller is attached to the rolling pipe at an appropriate connection 68. The discharge end of the rolling pipe is always in position over the hopper.

Figure 3A:
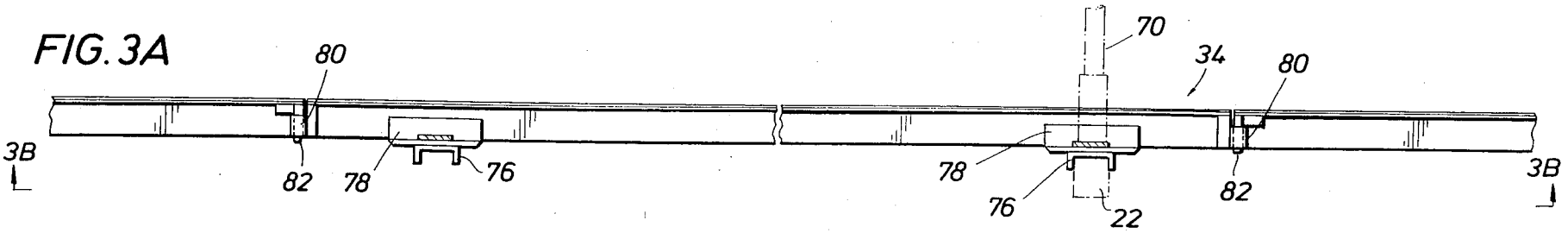
FIG. 3A is a cross-sectional view taken at line 3A—3A shown in FIG. 3.
Figure 3B:
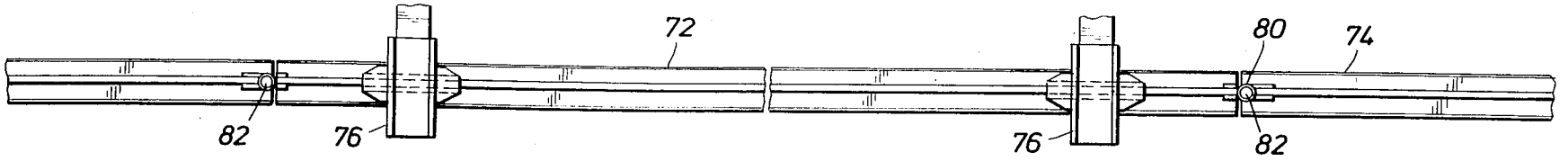
FIG. 3B is a cross-sectional view taken at line 3B—3B shown in FIG. 3A.
Figure 6:
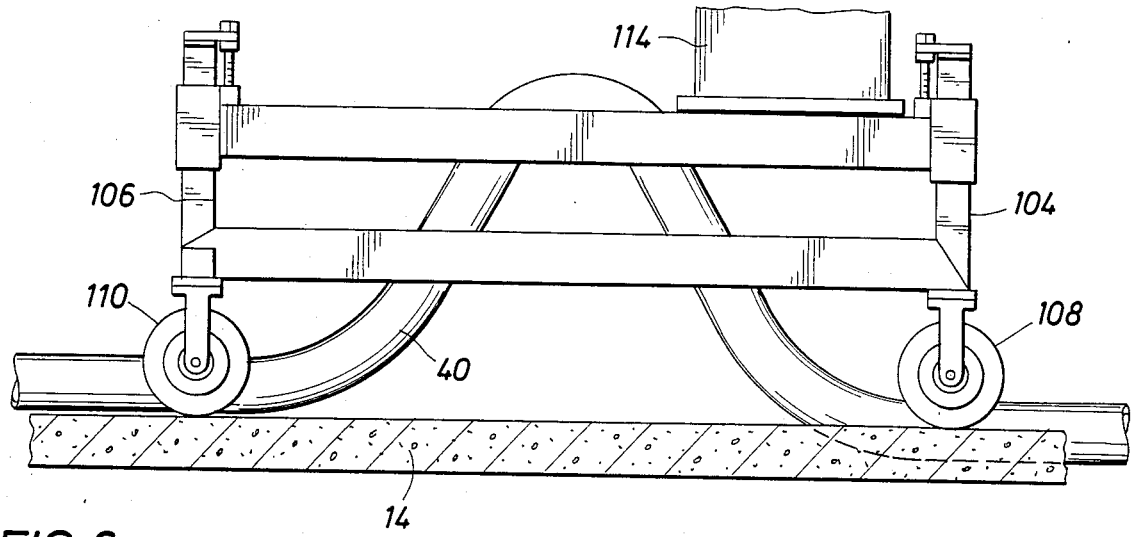
FIG. 6 is a side view of the tractor taken at line 6—6 in FIG. 5.

A detailed structure of preferred rail 34 in accordance with the present invention is illustrated in FIGS. 3A and 3B. The rail structure itself is described below; however, the rail is generally "T" shaped in a preferred embodiment and includes ten foot lengths 72 intermediate six foot lengths 74. The "T" rail is preferably made from a standard rolled structural tee cut from an "S" shaped beam that has the tee head milled to provide a uniform width with 60 degree Vee edges. The ten foot lengths are conveniently secured to the overhang brackets 22 by way of a saddle 76 that fits thereover and angle irons 78 that secure saddle 76 to rail 34. It should be noted that each of the ends of segment 72 ends in appropriate socket connection compatible with a socket connection included on the end of segment 74. To make the connection, sockets 80 are secured by an appropriate pin 82. Since segment 72 is longer than the distance between brackets 22, the brackets support the railing away from the connections and do not interfere therewith.

Now referring to FIGS. 4 and 5 in particular, as well as subsequent related drawings, tractor portion 38 of the apparatus which has been previously illustrated is shown in greater detail. The framework of tractor 38 on its rail side comprises a forward vertical leg 84 and a rearward vertical leg 86. A longitudinal brace 88 is appropriately secured to each leg 84 and 86 and support braces 89 and 90 add stability to this portion of the framework. Leg 84 is connected to an idler trolley 92, which is described more fully below. Leg 86 is secured to power trolley 94, also described more fully below. However, both trolleys include two pair of wheels compatible with rail 34 for attachment thereto. Vertical leg 84 is secured to forward horizontal brace 96, which is adjustable via an internal screw jack, and vertical leg 86 is secured to the rear horizontal brace 98 in the same fashion. Brace 98 also is similarly adjustable. The horizontal braces are, in turn, connected to a longitudinal brace 100, which is similar to brace 88 and opposite thereto. Therefore, the top of the frame is defined by forward horizontal brace 96 and rear horizontal brace 98 and longitudinal braces 88 and 100. A diagonal brace 102, also adjustable, extends from the inner section of brace 96 and 88 to the corner of 98 and 100. As previously mentioned, hose 40 is looped over this diagonal brace, which allows the tractor to straddle member 20, carry the hose connected to the rolling pipe, and to move the pipe forward. The remaining vertical leg structures, the ones on the pneumatic tire side, are leg 104 at the forward side of the structure and leg 106 at the rearward side of the structure. These legs are respectively located above the pneumatic tires, which ride initially on the approach and subsequently on the deck pavement where the tractor becomes located during use. On the forward end of the frame there is a single pneumatic wheel 108 and at the rear leg there are two pneumatic tires 110 and 112 mounted alongside each other. The three tires form a tricycle arrangement.

As previously mentioned several of the legs and braces are adjustable by internal screw jacks shown in dotted lines in the respective illustrations. An engine driven hydraulic pump unit 114 is mounted on longitudinal brace 100 for activating hydraulic drive motors 144 and 146.

Figure 7:
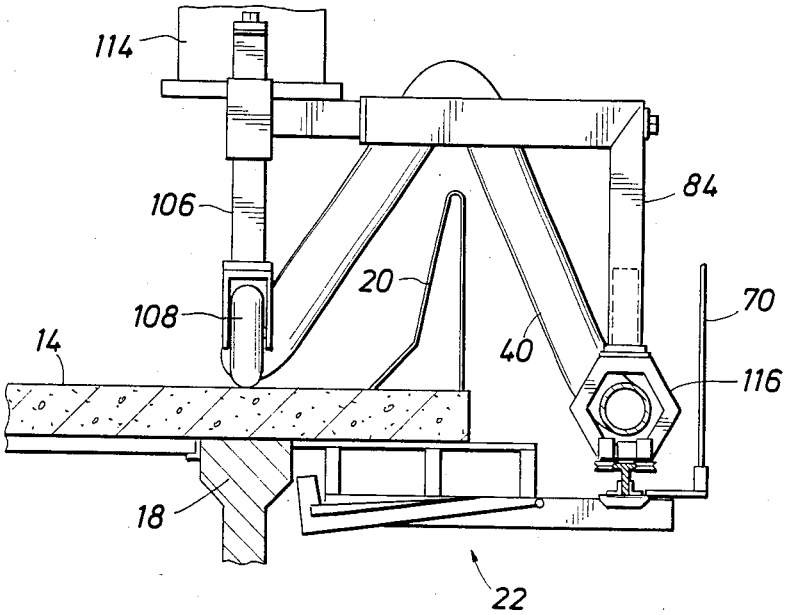
FIG. 7 is an end view of the tractor taken at line 7—7 in FIG. 4.
Figure 8:
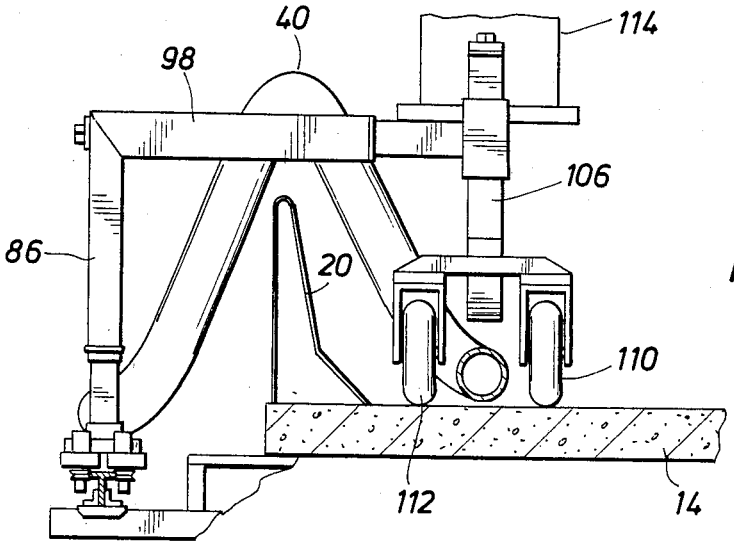
FIG. 8 is a rear view of the tractor taken at line 8—8 in FIG. 4.

Referring to FIG. 7, it will be seen that the lower part of forward vertical leg 84 terminates at its lower end in a structural ring 116 suitable for accommodating hose 40 that extends therethrough where it is then attached to the first section of the rolling pipe. Ring 116 is shown for convenience as being six sided, but it may be shaped otherwise. It should be further noted that hose 40 not only extends through structural ring 116, but it loops up and over diagonal brace 102, which is high enough to provide clearance over vertical railing reinforcement member 20. Hence, the tractor can roll along the rail on one side and the pavement on the other even though member 20 sticks up therebetween.

Figure 11:
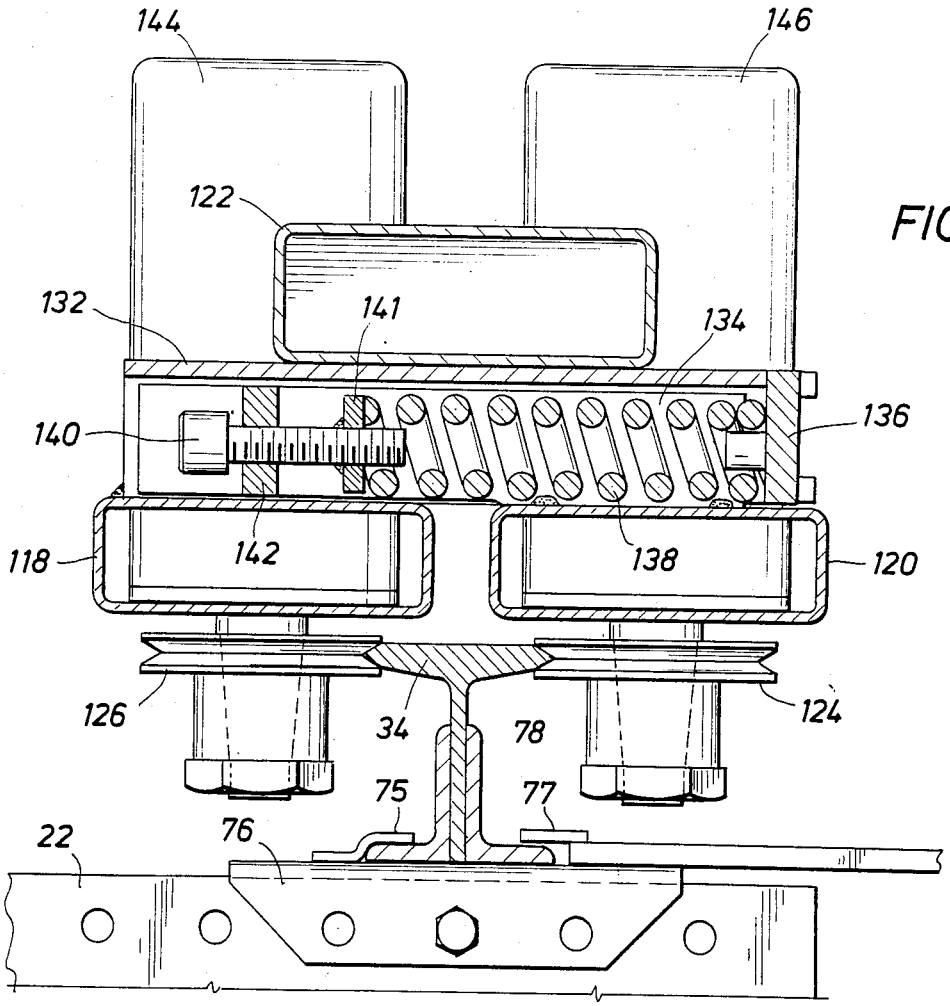
FIG. 11 is a cross-sectional view of the rail clamping mechanism of the drive portion of the tractor, taken at line 11—11 of FIG. 10.

Now referring to FIG. 11, the preferred construction of "T" rail 34 is illustrated. As previously mentioned, the "T" rail is preferably made from a standard rolled structural tee cut from an "S" shaped beam and has a "T" head milled to provide a uniform width with 60° V edges. Short angle irons 78 on either side of rail 34 are welded thereto. Guide clips 75 and 77 are welded to saddle 76, which is, in turn, bolted at the appropriate position to overhang bracket 22.

Each of the trolleys along the rail attached to the pipe are similar to the idler trolley of the tractor, except that the wheel spacing is fixed and they must be installed over the end of the rail, and therefore are not separately illustrated and described in detail. Now referring to the forward and rear trolleys of tractor 38, they are similarly constructed in that they are made up of structural steel channels supporting vertically mounted wheels for attachment to rail 34.

Figure 9:
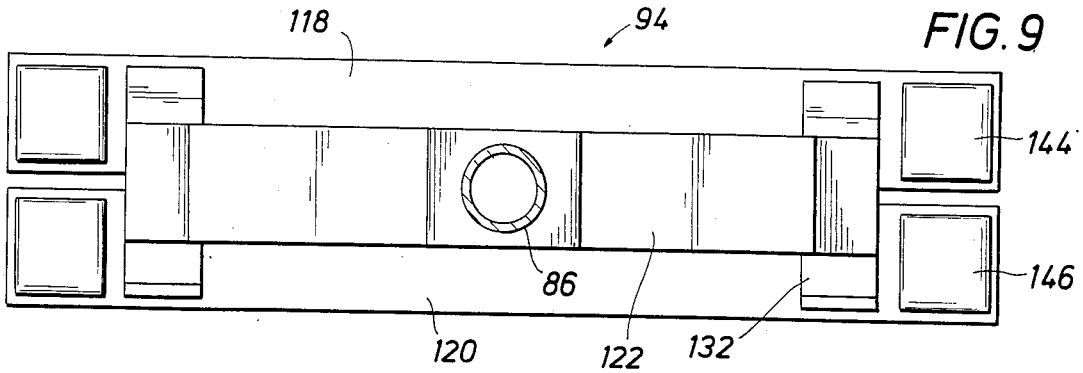
FIG. 9 is a top view of the drive portion of the tractor shown in FIGS. 4–8.
Figure 10:
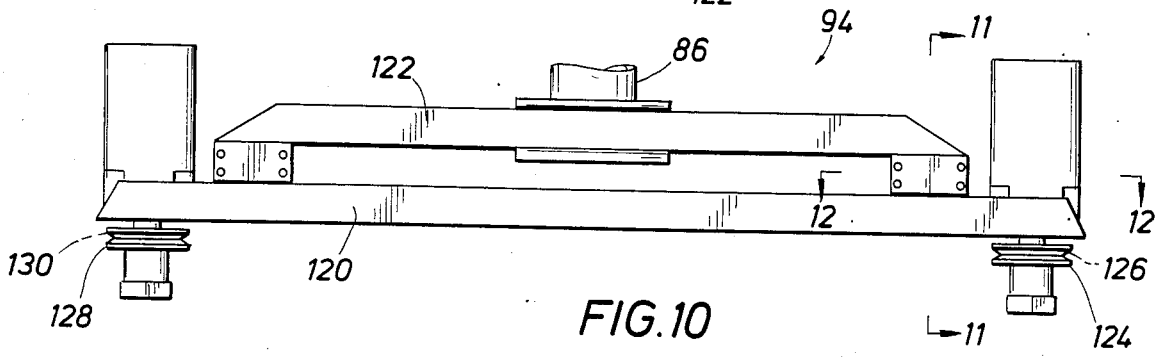
FIG. 10 is a side view of the drive portion of the tractor shown in FIG. 9.

FIGS. 9 and 10 illustrate power trolley 94, which includes channel members 118 and 120 supporting an elevated platform 122 to which the lower part of vertical leg 86 is attached. On either end of power trolley 94 are pairs of V grooved wheels suitable for gripping the edges of the "T" rail 34. At the rear end, these V grooved wheels are identified by reference numbers 124 and 126 and at the forward end by reference numbers 128 and 130. The wheels are each connected to the vertical shafts of hydraulic motors in conventional fashion. The hydraulic motors, in turn, are connected to the support channel members to which they are attached, also in conventional fashion. The wheels are spaced so that the V groove in the wheel engage the V edges at the head of the "T" rail.

Channel members 118 and 120 are connected together in a telescoping fashion with respect to rail 34 by U-channel member 132 welded to member 118 and by flat bar members 134 and 135 welded to channel member 120. A cap plate 136 is secured to one end of U-channel member 132 to provide access to a very large and powerful compression spring 138. The opposite end of spring 138 bears against plate washer 141 which is welded to adjustment bolt 140. This plate can be thought of as being an integral part of the adjustment bolt. A plate 142 welded to the insides of flat bars 134 and 135 also accepts adjustment bolt 140 so that as bolt 140 is tightened channel members 118 and 120 are drawn together. Bearing points 131 and 133 welded respectively at about the mid-points of the legs of U-channel member 143 each point inwardly to be respectively opposite bars 134 and 135. These points allow thrust to occur between members 118 and 120 without binding at members 132 and 134 or 135 even through there might be some tolerance-related misalignment of the ports. As bolt 140 is loosened, these channel members are held less tightly together and are thus permitted to expand apart. Hydraulic drive motors 144 and 146 are located over wheels 124 and 126, respectively, for providing the drive impetus to the wheels. In similar fashion, additional hydraulic motors are provided to drive the front two wheels on the power trolley in similar fashion.

The front trolley to the tractor includes only idler wheels, which are spaced to engage the rail in a loose fit. Further, the additional idler trolleys are located at approximately ten foot intervals along the rail. In each of the cases of the idler trolleys along the rail, the pipe is securely attached by strapping to the trolley so that when the tractor moves forward the rolling pipe is also moved in a forward direction. The pipe is attached inside the ring of leg 84 by means dictated by the type of pipe used.

It may be noted that the structure of the tractor is such that the idler trolley and the power trolley can be interchanged for movement in the opposite direction, if desired.

Although a preferred embodiment of the tractor has been shown having both a power trolley and an idler trolley, a simplified version thereof does not include an idler trolley arrangement but merely an extension whereby the rolling pipe or the flexible hose connected thereto is secured on an extended end. Appropriate guide means in the form of rings or otherwise are provided to carry the hose to the inside of the trolley, as desired. In not every case will a reinforcement beam be present and therefore in some cases it is not necessary to have a structure that lifts a hose over a reinforcing member.

Although the rail has been described as preferably including a "T" head with beveled edges, alternate rail configurations and suitable wheels connecting thereto can be employed, if desired.

It should also be apparent that the power trolley portion of the tractor can be used to provide the required tractive effort to any rail mounted tool or equipment where dead weight to provide sufficient friction between the rail and the drive wheels is undesirable.

Further, the description herein has been with respect to a bridge. It should be mentioned that other long areas that are awkwardly inaccessible, such as a tunnel, can be poured using a similar procedure and with similar equipment.

While a preferred embodiment of the invention has generally been described and specific variations have been discussed, it will be understood that the invention is not limited thereto.

What is claimed is:

1. The method of automatedly pouring and finishing concrete slabs in place on a bridge, which comprises establishing equipment support rails on stable overhang brackets located on either side of and outside of the slab area to be poured, serially mounting a concrete distributor having an input hopper and a concrete finisher on said equipment support rails for suspension over and subsequent longitudinal movement with respect to the area to be poured, establishing a rolling pipe rail on said stable overhang brackets outside of and parallel with one of said equipment support rails, said rolling pipe rail extending along a stable adjacent approach area to the area to be poured, locating a concrete pump on said stable adjacent approach area to the area to be poured, mounting a motor-driven tractor on said rolling pipe rail on the portion thereof extending along said stable adjacent approach area to the area to be poured, installing a rolling pipe on said rolling pipe rail, its downstream end being attached to the hopper of said distributor and its upstream end being attached to said tractor, the length of said rolling pipe being sufficient to permit its downstream end to traverse the length of the area to be poured, connecting the input upstream end of said rolling pipe at said tractor with said stationary pump using a serpentine hose, and providing a controller at said hopper for regulating the advance of said tractor in accordance with the advance of said concrete distributor while delivering concrete to the area to be poured, the advance of the tractor pushing said rolling pipe forward while unwinding said serpentine hose.

2. The method in accordance with claim 1 and including mounting on said equipment support rails a texturing machine following said concrete finisher for movement with said concrete distributor and said concrete finisher.

3. Apparatus for effecting the automated pouring and finishing concrete slabs in place on a bridge, comprising a plurality of stable overhang brackets located on either side of and outside of the slab area to be poured, equipment support rails located along the attached to and supported by said overhang brackets, a concrete distributor including a receiving hopper mounted on said equipment support rails for longitudinal movement over the area to be poured, a concrete finisher independently mounted on said equipment support rails for longitudinal movement over the area to be poured subsequent to said distributor, a rolling pipe rail located along and supported by the overhang support brackets located on one side of the slab area to be poured, said rolling pipe rail extending longitudinally onto the approach area, a rolling pipe mounted on said rolling pipe rail connected at its output end to said hopper of said distributor, a concrete pump located on the approach area to the area to be poured, a motor driven tractor located on the approach area to the area to be poured supporting said rolling pipe and rolling said rolling pipe along said rolling pipe rail, and a flexible hose connecting the input end of said rolling pipe with said concrete pump, said hose being laid in a serpentine configuration on the approach area prior to the pour of concrete into the area to be poured, wherein concrete slurry flows from said pump, through said hose and rolling pipe to said distributor hopper to be distributed into the area to be poured, said distributor, finisher and rolling pipe coordinately moving foward longitudinally to pour and finish the area to be poured.

4. Apparatus in accordance with claim 3, wherein said tractor includes power driven wheel means attached to said rolling pipe rail, idler wheel means longitudinally aligned with said power-driven wheel means and attached to said power-driven wheel means, tire means for rolling on the approach area for stabilizing said tractor from turning movements of force as the tractor moves longitudinally on the rail, and support means attached to said power-drive wheel means, idler wheel means and means to straddle and guide said rolling pipe over vertical railing reinforcing structures on the side next to the area to be poured.

5. Apparatus in accordance with claim 3, and including a controller mounted adjacent said concrete distributor and connected to said tractor for signally the advance of said tractor as determined by the incremental filling of the area to be poured by the concrete from said concrete distributor.

6. Apparatus in accordance with claim 3, and including a texturing machine mounted on said equipment support rails subsequent to said concrete finisher for longitudinal movement with said concrete distributor and said concrete finisher.

* * * * *